US005313802A

United States Patent [19]

Agrawal et al.

[11] Patent Number: 5,313,802

[45] Date of Patent: May 24, 1994

[54] PROCESS TO PRODUCE A KRYPTON/XENON ENRICHED STREAM DIRECTLY FROM THE MAIN AIR DISTILLATION COLUMN

[75] Inventors: Rakesh Agrawal, Emmaus; Steven L. Feldman, Macungie, both of Pa.

[73] Assignee: Air Products and Chemicals, Inc., Allentown, Pa.

[21] Appl. No.: 17,554

[22] Filed: Feb. 16, 1993

[51] Int. Cl.[5] ..... F25J 3/04

[52] U.S. Cl. ..... 62/22; 62/18; 62/24; 62/27

[58] Field of Search ..... 62/18, 22, 24, 27

[56] References Cited

U.S. PATENT DOCUMENTS

| | | | |
|---|---|---|---|
| 3,751,934 | 8/1973 | Frischbier | 62/41 |
| 3,779,028 | 12/1973 | Schuftan et al. | 62/22 |
| 4,421,536 | 12/1983 | Mori et al. | 62/18 |
| 4,568,528 | 2/1986 | Cheung | 423/262 |
| 5,039,500 | 8/1991 | Shino et al. | 62/22 X |
| 5,063,746 | 11/1991 | Agrawal et al. | 62/22 |
| 5,067,976 | 11/1991 | Agrawal et al. | 62/22 |
| 5,069,698 | 12/1991 | Cheung et al. | 62/22 |
| 5,122,173 | 6/1992 | Agrawal et al. | 62/22 |

*Primary Examiner*—Henry A. Bennet
*Assistant Examiner*—Christopher Kilner
*Attorney, Agent, or Firm*—Robert J. Wolff; William F. Marsh; James C. Simmons

[57] ABSTRACT

A process is set forth for producing a krypton/xenon enriched stream directly from the main air distillation column in a cryogenic air separation process. A column bypass is suggested in the bottom few trays of the low pressure column in order to concentrate krypton and xenon in the sump while rejecting the majority of methane in the gaseous oxygen product.

7 Claims, 1 Drawing Sheet

PROCESS TO PRODUCE A KRYPTON/XENON ENRICHED STREAM DIRECTLY FROM THE MAIN AIR DISTILLATION COLUMN

TECHNICAL FIELD

The present invention relates to a process for the cryogenic distillation of air into its constituent components wherein a stream enriched in krypton and xenon is produced directly from the main air distillation column.

BACKGROUND OF THE INVENTION

Krypton and xenon are present in air as trace components, 1.14 parts per million by volume (1.14 vppm) and 0.086 vppm, respectively, and can be produced in pure form from the cryogenic distillation of air. Both of these elements are less volatile (i.e., have a higher boiling temperature) than oxygen and therefore concentrate in the liquid oxygen sump of a conventional double column air separation unit. Other impurities which are also less volatile than oxygen (most notably methane) also concentrate in the liquid oxygen sump along with krypton and xenon.

Unfortunately, process streams containing oxygen, methane, krypton and xenon present a safety problem due to the combined presence of methane and oxygen. Methane and oxygen form flammable mixtures with a lower flammability limit of 50% methane in oxygen. In order to operate safely, the methane concentration in an oxygen stream must not be allowed to reach the lower flammability limit and, in practice, a maximum allowable methane concentration is set that is a fraction of the lower flammability limit. This maximum constraint effectively limits the concentration of the krypton and xenon that is attainable in the sump as any further concentration of these products would also result in a methane concentration exceeding the maximum allowed.

The conventional technology accepts this limitation on the concentration of the krypton and xenon that is attainable in the liquid oxygen boiling in the sump and removes methane in a separate distillation column (typically referred to in the art as the raw krypton/xenon column) so that further concentrating of the krypton and xenon in the liquid oxygen stream (usually via distillation) can safely be performed. See for example the processes taught in the following U.S. Pat. Nos. 3,751,934; 4,568,528; 5,063,746; 5,067,976; and 5,122,173.

It is an object of the present invention to remove in the main air distillation column the methane which is conventionally removed in the raw krypton/xenon column, thereby saving the expense of a separate distillation column and the associated reboiler/condenser.

SUMMARY OF THE INVENTION

The present invention is a method for producing a stream enriched in krypton and xenon. The method is applicable to a process for the cryogenic distillation of an air feed using a multiple column distillation system comprising a high pressure column and a low pressure column wherein:

(a) at least a portion of the air feed is fed to the high pressure column in which the air feed is rectified into a high pressure nitrogen overhead and a high pressure crude liquid oxygen bottoms;

(b) at least a portion of the high pressure crude liquid oxygen bottoms is fed to the low pressure column in which the high pressure crude liquid oxygen bottoms is rectified into a low pressure nitrogen overhead and a low pressure liquid oxygen bottoms; and (c) at least a portion of the low pressure liquid oxygen bottoms is boiled in a sump located in the bottom of the low pressure column.

The method for producing the stream enriched in krypton and xenon in the above process comprises:

(i) withdrawing an oxygen-enriched vapor stream and an oxygen-enriched liquid stream from a withdrawal point located at least one equilibrium stage above the sump;

(ii) returning the oxygen-enriched liquid stream to a return point located between the sump and the low pressure column's initial equilibrium stage; and (iii) withdrawing the krypton/xenon enriched stream from the bottom of the sump.

As used herein, an equilibrium stage is defined as a vapor-liquid contacting stage wherein the vapor and liquid leaving the stage are in mass transfer equilibrium.

DETAILED DESCRIPTION OF THE INVENTION

Figure 1:
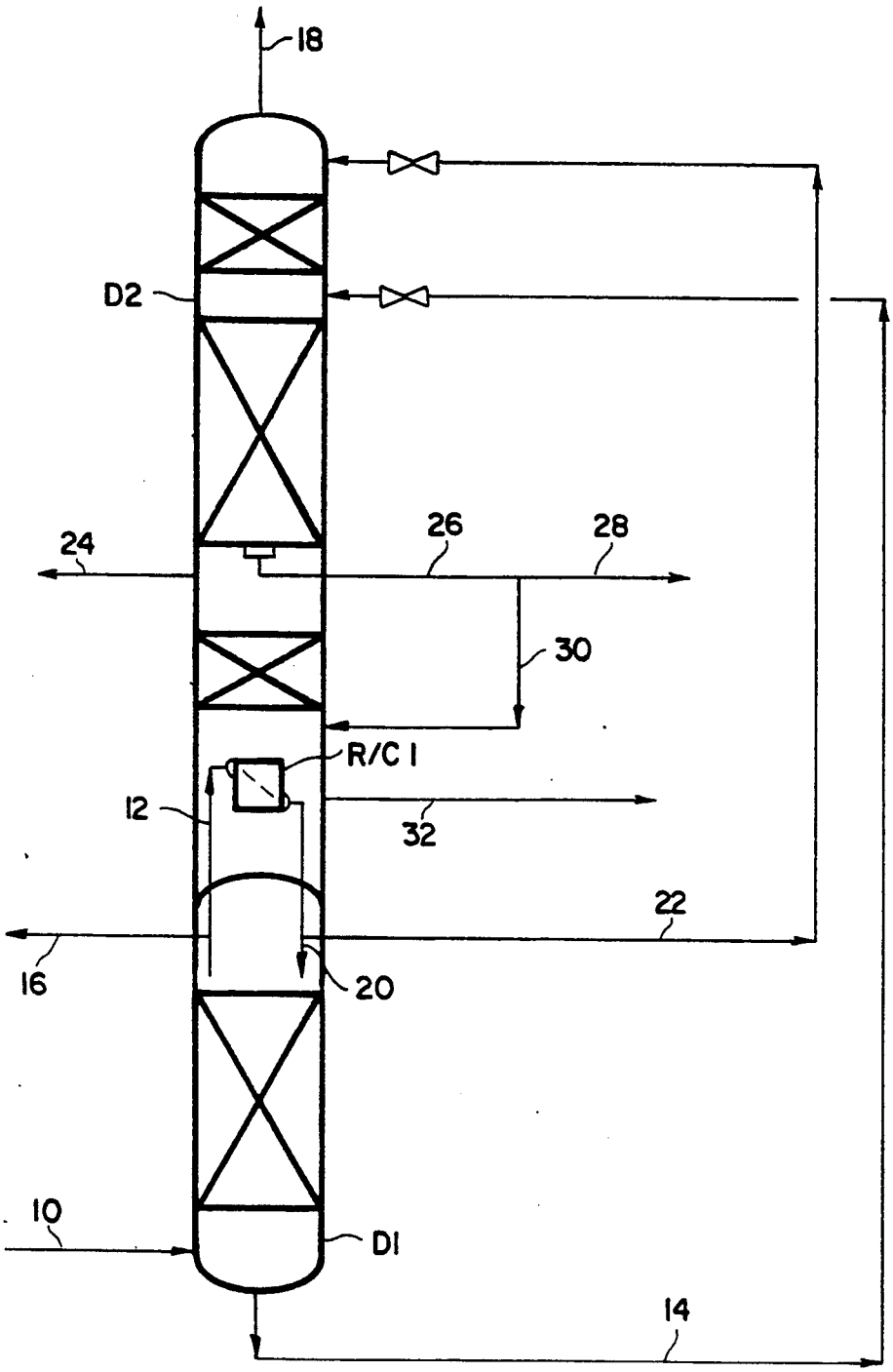
FIG. 1 is schematic diagram illustrating one embodiment of the present invention.

The process of the present invention will be described in detail with reference to the drawing.

Referring now to FIG. 1, an air feed 10 which has been compressed, cleaned of impurities which will freeze out at cryogenic temperatures and cooled down to cryogenic temperatures is introduced into a multiple column distillation system comprising high pressure column D1 and low pressure column D2. The air feed is more specifically fed to high pressure column D2 in which the air feed is rectified into a high pressure nitrogen overhead and a high pressure crude liquid oxygen bottoms 14. A portion of the high pressure nitrogen overhead is removed as a product stream in stream 16. At least a portion of the high pressure crude liquid oxygen bottoms 14 is fed to low pressure column D2 in which the high pressure crude liquid oxygen bottoms 14 is rectified into a low pressure nitrogen overhead 18 which is removed as a second product stream and a low pressure liquid oxygen bottoms which collects in the sump located at the bottom of the low pressure column. At least a portion of the low pressure liquid oxygen bottoms is boiled in a reboiler/condenser R/C 1 located in this sump by indirect heat exchange against condensing high pressure nitrogen overhead from stream 12. The condensed high pressure nitrogen overhead is used to provide reflux for high pressure column D1 via stream 20. A portion of this condensed high pressure nitrogen overhead can also be used to reflux low pressure column D2 as shown by stream 22 in FIG. 1. An oxygen-enriched vapor stream 24 is withdrawn as a portion of the vapor ascending low pressure column D2 at a withdrawal point located at least one equilibrium stage above the low pressure column's sump. At this same withdrawal point, an oxygen-enriched liquid stream 26 is similarly withdrawn as a portion of the liquid descending low pressure column D2. A portion of stream 26 is removed as a third product stream 28 while the remainder is reintroduced into the low pressure column as stream 30 at a return point located between the sump and the initial equilibrium stage of low pressure column D2. Finally, a krypton/xenon enriched stream 32 is withdrawn from the bottom of the low pressure column's sump as a fourth product stream.

The key to the present invention as embodied in FIG. 1 is that the withdrawal of the oxygen-enriched liquid stream 26 decreases the liquid reflux in those equilibrium stages of the low pressure column between the withdrawal and return points (i.e. the "bypassed" stages which will typically consist of three equilibrium stages although there can be any desired number) such that the majority of the methane contained in the air feed can be rejected in the oxygen-enriched vapor stream 24. Preferably, the reflux is decreased to a point such that the ratio of liquid to vapor in the bypassed equilibrium stages is reduced from its normal value of greater than 1.0 to a value between 0.05 and 0.40. In this ratio range, the descending reflux is sufficient to strip most of the krypton and nearly all of the xenon from the ascending vapor but is insufficient to strip the majority of the methane from the ascending vapor. (The boiling points of methane, krypton and xenon are −161° C., −152° C. and −109° C. respectively). This allows the methane to be removed as part of the oxygen-enriched vapor stream which is withdrawn as stream 24 in FIG. 1. The lower limit of the ratio reflects the fact that at some point, there will be insufficient reflux to wash the krypton from the ascending vapor as well. The optimum value of the ratio will depend on just how much krypton one can tolerate to lose in the oxygen-enriched vapor stream which is withdrawn as stream 24 in FIG. 1.

It should be noted that for simplification, the other heat exchangers generally used for heat exchange between various process streams have not been shown in FIG. 1. Furthermore, even though the boilup in the sump of low pressure column D2 is shown to be produced by heat exchange with nitrogen overhead form high pressure column D1, it is not essential to the present invention. The boilup at the bottom of the low pressure column can be provided by suitable heat exchange with one or more other process streams.

A consequence of concentrating the krypton and xenon in the sump is that other heavy, partially soluble contaminants (such as nitrous oxide) and hydrocarbons heavier than methane (such as ethane and propane, hereinafter referred to as $C_2+$ hydrocarbons) also concentrate in the sump. To deal with this problem, these components could be adsorbed by passing stream 30 through an adsorber (Note that such an adsorber would not be capable of also removing methane. Otherwise the need for the present invention would be obviated). Alternatively, this problem can be dealt with by exploiting the fact that krypton/xenon is typically recovered from large tonnage air separation plants which use multiple heat exchanger cores for reboiler/condenser duty. It is possible to first boil the liquid descending the low pressure column in all the heat exchanger cores except one. The remaining krypton/xenon concentrating heat exchanger core is segregated from the balance of the cores in a second sump to process the unboiled portion of the low pressure liquid oxygen bottoms. Said portion is withdrawn from the low pressure column sump and passed through an adsorbent bed. The liquid effluent from the adsorber, free of carbon dioxide, nitrous oxide and partially cleansed of ethane and propane is then sent to the second sump containing the segregated core for final boilup by indirect heat exchange against a condensing process stream such as a portion of the high pressure nitrogen overhead. The vapor stream is returned to the low pressure column, while a krypton/xenon enriched stream is removed from the bottom of the second sump. If needed, a liquid pump can be used to pump the portion of the low pressure liquid oxygen bottoms from the low pressure column sump to the second krypton/xenon concentrating sump. Note that this scheme can be used with either thermosyphon reboilers, whereby said portion is transferred by static head, or in a downflow reboiler whereby said portion is transferred either by a pump or by static head.

The following example is offered to demonstrate the efficacy of the present invention.

EXAMPLE

The purpose of this example is to demonstrate the preferential rejection of methane in the process of the present invention as embodied in FIG. 1. This was accomplished by performing a computer simulation for FIG. 1. The concentration of methane, krypton and xenon in air feed 10 was assumed to be 5 vppm, 1.14 vppm, and 0.086 vppm respectively. Table 1 summarizes the key process streams. All the flows listed in Table 1 are based on 100 moles/hr of air feed 10. Three equilibrium stages were used between the withdrawal and return points of low pressure column D2. Whereas the ratio of liquid to vapor above this bypassed section is about 1.41, due to the liquid bypass of this section via stream 30, the ratio within this bypassed section is only 0.1. The preferable rejection of methane in stream 24 of FIG. 1 is demonstrated by the fact that the concentration of methane in stream 24 is 24 vppm whereas the concentration of methane in the vapor leaving the equilibrium stage immediately above the bypassed section is only 7.9 vppm. Due to this preferable rejection of methane in stream 24, the concentration of krypton and xenon in stream 32 can be increased to 1082 vppm and 298 vppm respectively.

TABLE 1

| Stream # | 24 | 26 | 28 | 30 | 32 |
|---|---|---|---|---|---|
| Temp. (°C.) | −172 | −172 | −172 | −172 | −171 |
| Pressure (psia) | 41.6 | 41.4 | 41.4 | 41.6 | 42.1 |
| Flow (moles/hr) | 20.1 | 72.7 | 0.9 | 64.6 | 0.0286 |
| Oxygen (%) | 99.6 | 99.6 | 99.6 | 99.6 | 99.6 |
| Argon (%) | 0.36 | 0.36 | 0.36 | 0.36 | 0.17 |
| Krypton (vppm) | 3.9 | 4.3 | 4.3 | 4.3 | 1082 |
| Xenon (vppm) | 0.06 | 0.12 | 0.12 | 0.12 | 298 |
| Methane (vppm) | 24.0 | 24.0 | 24.0 | 24.0 | 249 |

The present invention has been described with reference to a specific embodiment thereof. This embodiment should not be seen as a limitation of the scope of the present invention; the scope of such being ascertained by the following claims.

We claim:

1. In a process for the cryogenic distillation of an air feed using a multiple column distillation system comprising a high pressure column and a low pressure column wherein:

(a) at least a portion of the air feed is fed to the high pressure column in which the air feed is rectified into a high pressure nitrogen overhead and a high pressure crude liquid oxygen bottoms;

(b) at least a portion of the high pressure crude liquid oxygen bottoms is fed to the low pressure column in which the high pressure crude liquid oxygen bottoms is rectified into a low pressure nitrogen overhead and a low pressure liquid oxygen bottoms; and (c) at least a portion of the low pressure liquid oxygen bottoms is boiled in a sump located in the bottom of the low pressure column;

a method to produce a stream enriched in krypton and xenon directly from the low pressure column comprising:

(i) withdrawing an oxygen-enriched vapor stream and an oxygen-enriched liquid stream from a withdrawal point located at least one equilibrium stage above the sump;

(ii) returning the oxygen-enriched liquid stream to a return point located between the sump and the low pressure column's initial equilibrium stage; and (iii) withdrawing the krypton/xenon enriched stream from the bottom of the sump.

2. The process of claim 1 wherein the amount of the oxygen-enriched liquid stream withdrawn in step (i) is sufficient to decrease the ratio of liquid to vapor in that section of the low pressure column between the withdrawal and return points to a value between 0.05 and 0.4.

3. The process of claim 1 wherein there are three equilibrium stages between the withdrawal and return points.

4. The process of claim 1 wherein subsequent to step (i) and prior to step (ii), the process further comprises removing any $C_2+$ hydrocarbons and nitrous oxide from the oxygen-enriched liquid stream in an adsorber.

5. The process of claim 1 wherein the portion of the low pressure liquid oxygen which is boiled in the sump in step (c) is boiled by indirect heat exchange against condensing high pressure nitrogen overhead and wherein at least a portion of the condensed high pressure nitrogen overhead is used to provide reflux for the distillation system.

6. The process of claim 1 wherein subsequent to step (iii), the process further comprises:

(iv) removing any $C_2+$ hydrocarbons and nitrous oxide from the krypton/xenon enriched stream in an adsorber;

(v) boiling the krypton/xenon enriched stream in a second sump by indirect heat exchange against a condensing process stream wherein the vapor is returned to the low pressure column and wherein a product stream further enriched in krypton/xenon is withdrawn from the bottom of the second sump.

7. The process of claim 6 wherein the condensing process stream is a portion of the high pressure nitrogen overhead.

* * * * *